United States Patent [19]

Beaulieu

[11] Patent Number: 4,799,634

[45] Date of Patent: Jan. 24, 1989

[54] HOOK FOR RELEASING PARACHUTE OR THE LIKE FROM A KITE

[76] Inventor: Nelson K. Beaulieu, 152, chemin de l'Aéroport, Thetford Mines, Quebec, Canada, G6G 5R7

[21] Appl. No.: 49,215

[22] Filed: May 13, 1987

[51] Int. Cl.[4] ..... A63H 27/08

[52] U.S. Cl. ..... 244/155 R

[58] Field of Search ..... 244/153 R, 155 R, 155 A

[56] References Cited

U.S. PATENT DOCUMENTS 2,059,634 11/1936 Fisher, Jr. ..... 244/155 R 2,452,746 11/1948 Giara ..... 244/155 R 2,822,998 2/1958 Toth ..... 244/155 R

*Primary Examiner*—Galen Barefoot

*Assistant Examiner*—Rodney Corl

*Attorney, Agent, or Firm*—Roland L. Morneau

[57] ABSTRACT

A hook to be fixed to the lower end of the frame of a kite. The hook has an arm curved upwardly towards the top of the kite for supporting an object such as a parachute when the kite is in a vertical position and for dropping the parachute when the kite has reached a predetermined tilted position.

2 Claims, 1 Drawing Sheet

HOOK FOR RELEASING PARACHUTE OR THE LIKE FROM A KITE

BACKGROUND OF THE INVENTION

Various devices have been contemplated for releasing parachute from a kite but in general they required a relatively complex arrangement of parts.

In Canadian Pat. No. 179,666 and U.S. Pat. No. 2,452,746, the inventors use a throw-off device which slides on the card of a kite to release the parachute.

U.S. Pat. No. 2,059,634 discloses a rod secured along the spar of a kit for holding a resilient arm with a ring. The cord of the kite must be jerked to release the parachute.

BRIEF SUMMARY OF THE INVENTION

The invention relates to a hook fixed to the lower end of the frame of a kite. The hook comprises an arm extending from the spar of the kite and on the side thereof. The arm forms an angle of less than 90 degrees with the spar which is located along the longitudinal axis of the kite.

The kite, when launched, is in a substantially vertical position and the hook is in a direction pointing above the horizon. As the kite rises in the sky, it tends to tilt towards an horizontal position. The hook will gradually point downwardly until the object which is supported by it slides out of it.

DETAILED DESCRIPTION OF THE INVENTION

Figure 1:
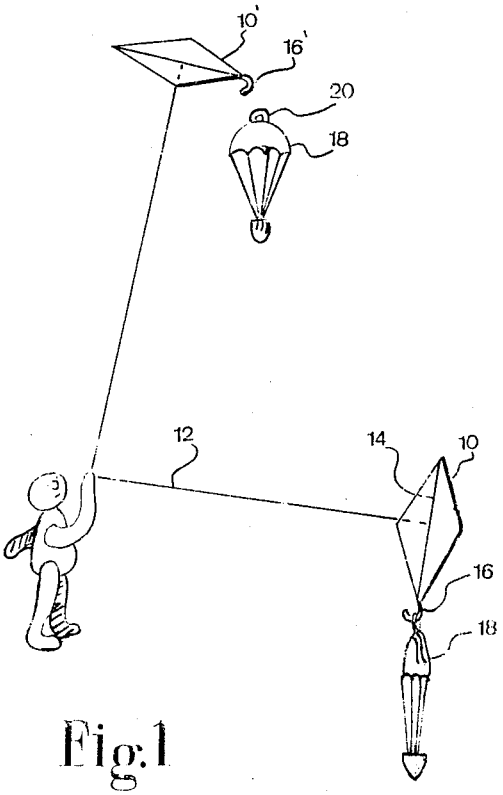
FIG. 1 shows a schematic view of a kite and a hook according to the invention in an initial position of flight and in its position for launching a parachute.

FIG. 1 shows a kite 10 pulled by a chord 12 in its initial position of flight. The plane of the kite is substantially vertical. The spar 14 which is located along the longitudinal axis of the kite is fitted at its lower end with a hook 16 for supporting a parachute 18. When the kite has reached a certain height, such as at 10' in FIG. 1, the plane of the kite and the hook is sufficiently tilted relative to the horizon to release the parachute. The parachute is preferably provided at its apex with a ring 20 so as to facilitate the sliding out of the hook 16'.

Figure 2:
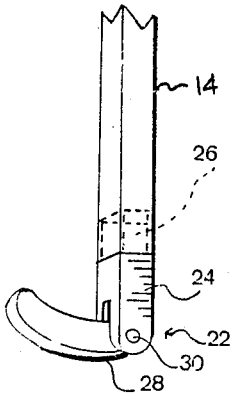
FIG. 2 is a perspective view of one embodiment of a hook fixed at the lower end of a kite.

Various types of hooks can be adapted for installation at the lower end of the spar. In FIG. 2, the hook 22 comprises a shank 24 provided with a stub 26 adapted to fit tightly into a hollow portion of the spar 14. An arm 28 is pivotally connected to the shank 24 through an axle 30. The arm 28 is curved in the direction of the shank 24 and consequently in the direction of the spar 14. The arm 28 is frictionally engaged in the shank 24 and can support a predetermined weight corresponding to the object which will be carried such as the parachute 18. The specific shape of the arm 28 may vary but in general the distance between the outer tip of the arm 28 and shank 24 or spar 14 is one factor for determining at which angle or at which height the kite can release the parachute.

Figure 3:
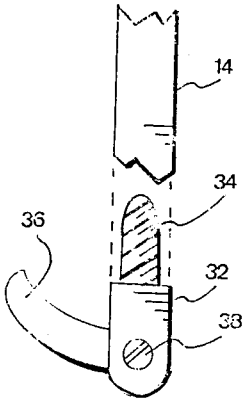
FIG. 3 is a side view of another embodiment of the hook with the spar partly removed.

The embodiment shown in FIG. 3, has a shank 32 which fits into a hollow portion of the spar 14 with a threaded stub 34. The arm 36 is pivotally connected to the shank 32 and its angular movement can be frictionally adjusted with a tightening screw 38.

Figure 4:
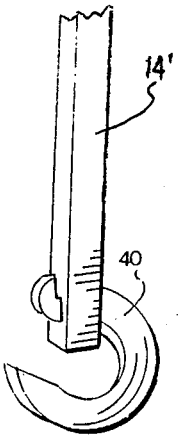
FIG. 4 is a perspective view of another embodiment of a hook.
Figure 5:
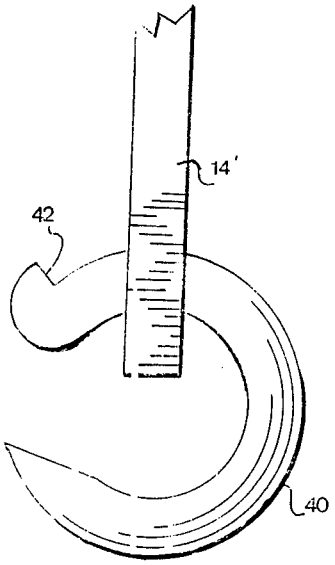
FIG. 5 is a side view of the embodiment shown in FIG. 4 with the hook partly rotated in the spar.

A different embodiment is illustrated in FIGS. 4 and 5. The spar 14' is provided with a transversal aperture through which a hook 40 is frictionally inserted. The hook 40 is U-shaped with a generally circular contour. At one end, it is provided with a notch 42 which acts as a stopper when the hook 40 slides through the perforated spar 14'. The cross-section of the hook 40 is constant from the plane of the notch 42 and for most of its contour so as to maintain a predetermined frictional engagement with the spar. Such engagement is determined in such a way so that the weight of the object hanging from the hook will not make the latter slide through the spar 14'.

In actual operation, the arm 28 or 36 or the hook 40 is angularly positioned depending at which height the parachute 18 is intended to be released. The smaller the angle between the arm 28 or 36 with the spar 14, the higher the parachute will be released, all other things being equal. This condition is reached for the embodiment shown in FIGS. 4 and 5 when the notch 42 is in contact with spar 14'.

It is obvious that objects other than the parachute can be launched from the hook of a kite. Such objects could be small toy airplanes, inflatable plastic toys, garlands or the like.

I claim:

1. A releasing hook member adapted to be fixed at the lower end of a kite frame, the said hook member comprises a U-shaped arm having a general circular contour adapted to frictionally slide into a slot provided in the said lower end of the kite frame, the said hook having a protuberant notch at one end for stopping said hook member in said slot.

2. A kite comprising a frame having a rigid spar along its longitudinal axis and a chord for pulling said frame, a hook member fixed at the lower end of said spar, the said hook member comprising a curved arm extending away from said spar in a direction parallel to said chord and perpendicular to the plane of said frame and forming an angle of less than 90° with said spar, said curved arm having a U-shape and having a general circular contour adapted to frictionally slide into a slot provided in the lower end of said spar, the said hook having a protuberant notch at one end for stopping said hook member in said slot.

* * * * *